US005697419A

United States Patent [19]

Karaki et al.

[11] Patent Number: 5,697,419

[45] Date of Patent: Dec. 16, 1997

[54] METHOD FOR COATING A DIE SURFACE WITH RELEASE AGENT

[75] Inventors: Mitsuhiro Karaki, Okazaki; Mikiya Nozaki; Naoya Yamamoto, both of Toyota, all of Japan

[73] Assignee: Toyota Jidosha Kabushiki Kaisha, Toyota, Japan

[21] Appl. No.: 516,982

[22] Filed: Aug. 18, 1995

[30] Foreign Application Priority Data

| | | | |
|---|---|---|---|
| Aug. 19, 1994 | [JP] | Japan | 6-195410 |
| Dec. 22, 1994 | [JP] | Japan | 6-319931 |
| Jun. 7, 1995 | [JP] | Japan | 7-140552 |

[51] Int. Cl.[6] ..... B22C 3/00

[52] U.S. Cl. ..... 164/72; 164/113; 164/267

[58] Field of Search ..... 164/72, 113, 267, 164/119

[56] References Cited

U.S. PATENT DOCUMENTS

| | | | |
|---|---|---|---|
| 1,811,610 | 6/1931 | Carlile . | |
| 3,836,372 | 9/1974 | Horton . | |
| 5,388,631 | 2/1995 | Suganuma et al. | 164/72 |
| 5,401,801 | 3/1995 | Naganawa . | |

FOREIGN PATENT DOCUMENTS

| | | | |
|---|---|---|---|
| 0 281 318 | 9/1988 | European Pat. Off. . | |
| 0 550 028 | 7/1993 | European Pat. Off. . | |
| 0 697 262 | 2/1996 | European Pat. Off. . | |
| 16 08 759 | 12/1970 | Germany . | |
| 63-180150 | 11/1988 | Japan . | |
| 4138861 | 5/1992 | Japan . | |
| 6-122057 | 5/1994 | Japan | 164/72 |
| 753523 | 8/1980 | U.S.S.R. | 164/72 |
| 2 003 922 | 3/1979 | United Kingdom . | |

*Primary Examiner*—Joseph J. Hail, III
*Assistant Examiner*—I.-H. Lin
*Attorney, Agent, or Firm*—Cushman, Darby & Cushman IP Group Of Pillsbury Madison & Sutro LLP

[57] ABSTRACT

A method for coating a die surface with a foamed release agent is disclosed. The release agent is foamed outside a die and then is supplied to a die cavity. Alternatively, liquid release agent is supplied to the die cavity and then is foamed inside the die. Excess foamed release agent is removed from the die before molten metal is supplied to the cavity. Alternatively, the foamed release agent is left in the cavity, and molten metal is supplied to the cavity. The release agent is foamed through mechanical agitation, bubbling, or by gas released from the release agent when heated.

19 Claims, 10 Drawing Sheets

METHOD FOR COATING A DIE SURFACE WITH RELEASE AGENT

BACKGROUND OF THE INVENTION

1. Field of the Invention

The present invention relates to a method for coating a die surface of a die cavity with a release agent such that mineral powders of the release agent remain uniformly dispersed within the release agent and are, consequently, uniformly deposited onto the die surface.

2. Description of Related Art

In a conventional method of coating a die surface with release agent, as disclosed in Japanese Utility Model Publication No. SHO 63-180150, a mold die is opened, and a spray nozzle is inserted into the open die. Thereafter, a release agent is injected from the nozzle onto a die surface of the opened die. Alternatively, as disclosed in Japanese Patent Publication No. HEI 4-138861, liquid release agent is atomized and supplied into a closed die thereby coating its die surface with the release agent mist.

However, those conventional release agent coating methods have a problem with uniform dispersion. More particularly, release agents usually contain mineral powders suspended in a release agent liquid to improve their release characteristics. Those mineral powders have higher specific gravities than the release agent liquid and tend to settle out making the release agent non-homogeneous. Even if the release agent is agitated, it is difficult to make the release agent homogeneous again. Consequently, dispersion of the mineral powders injected onto a die surface varies at different locations of the die surface.

SUMMARY OF THE INVENTION

An object of the present invention is to provide a method for uniformly coating a die surface with release agent such that mineral powders of the release agent are dispersed evenly onto the die surface.

BRIEF DESCRIPTION OF THE DRAWINGS

These and other objects, features, and advantages of the present invention will become more apparent and will be more readily appreciated from the following detailed description of the preferred embodiments of the present invention when taken in conjunction with the accompanying drawings, wherein.

DETAILED DESCRIPTION OF THE PREFERRED EMBODIMENTS

Figure 1:
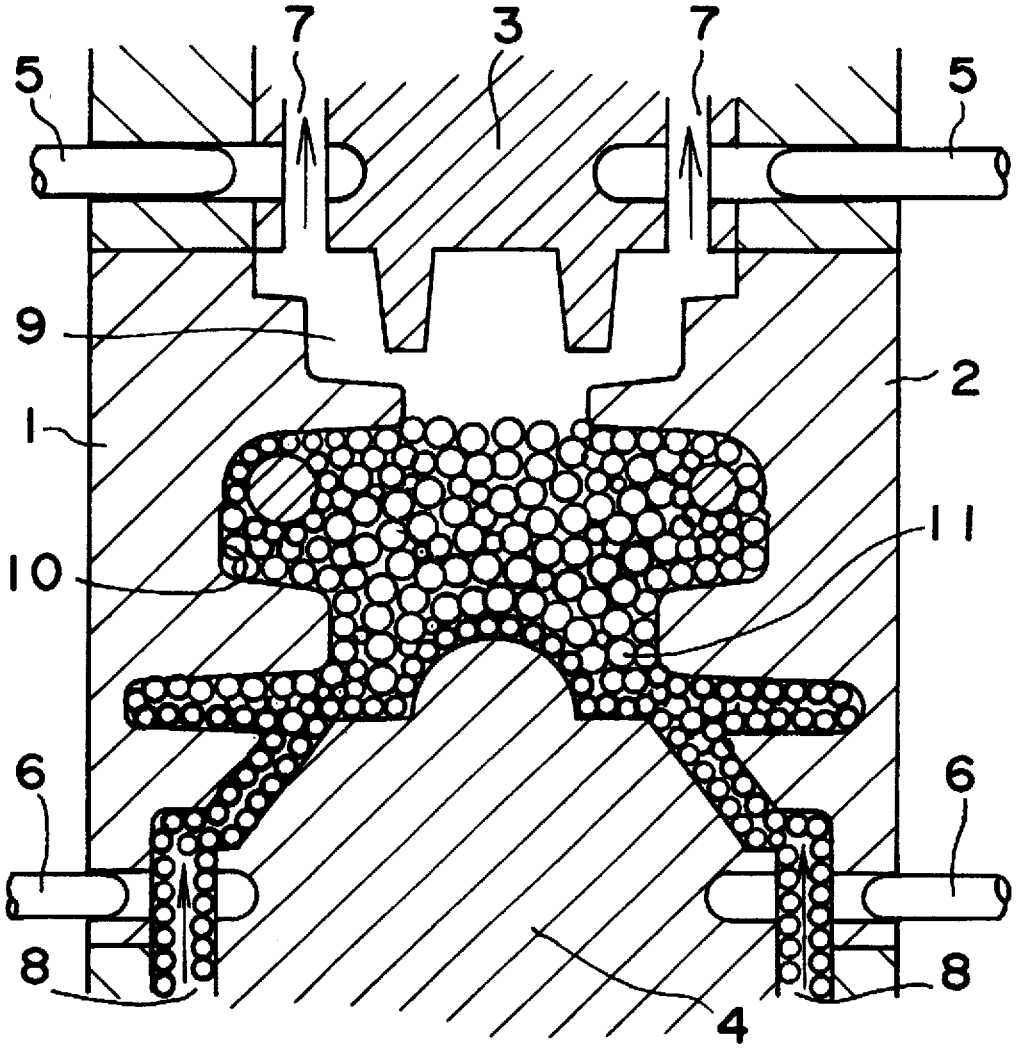
FIG. 1 is a cross-sectional view of a die supplied with a foamed release agent according to a first embodiment of the present invention.

Eight embodiments of the present invention will be explained below. Common elements and/or steps of the embodiments of the present invention are denoted with the same reference numerals throughout this description. The common elements and steps will be explained with reference to FIG. 2.

Generally, a method for coating a die surface with a release agent according to any embodiment of the present invention includes the steps of foaming the release agent 11 and coating a die surface 10 with the foamed release agent 11.

Any of the following methods, singularly or in combination, can be used to foam the release agent 11:

(1) The release agent is mixed with a foam generating material. Then, the release agent is mechanically agitated or pressurized gas is blown into the release agent so that the release agent foams. Suitable foam generating materials include sodium laurate or sodium stearate;

(2) The release agent is mixed with a surface active agent so that when the release agent contacts a die surface having a residual high temperature, the release agent foams. A nonionic surface active agent, for example, polyoxyethylenealkylallylether, is suitable for this application;

(3) Sodium hydrogencarbonate powders and air are mixed with each other. Thereafter, the mixture is added to the liquid release agent to foam the release agent;

(4) Pressurized carbonic acid gas is injected into the release agent to foam the release agent.

(5) A foaming agent containing volatile alcohol is added to the release agent at high pressures to foam the release agent; or (6) At high pressure (for example, 2 to 100 kg/cm$^2$) and low temperature (for example, 5 to −70° C. ), gas (for example, carbonic acid gas) is either dissolved in the liquid release agent or is liquefied and mixed with the liquid release agent. Then, the liquid release agent is supplied to the die and thereafter foams when the gas is released from the release agent after being heated by a die having a residual high temperature.

Next, the die surface is coated with the foamed release agent by covering the die surface with the foamed release agent.

As described, the mineral powders contained in the release agent do not settle out but are held in the membranes of bubbles of the foam. As a result, mineral powders contained in the release agent are dispersed evenly throughout the release agent and all portions of the die surface are coated with a homogeneous release agent.

Further, because the release agent is foamed, excess foamed release agent is separated easily and removed from the foamed release agent remaining on the die surface 10. As a result, after the excess foamed release agent is removed from the die, a thickness of the foamed release agent contacting the die surface 10 is homogeneous substantially at all portions of the die surface 10. Furtherstill, because the release agent is not atomized and released to the atmosphere, the excess release agent can be retrieved, and the release agent 11 consumed is minimized. Finally, a cooling rate of the die also can be controlled by controlling the bubble size of the foam, the water contained in the liquid release agent, and the temperature of the liquid release agent.

Next, steps unique to each embodiment of the present invention will be explained.

In a first embodiment of the present invention, as illustrated in FIG. 1, the release agent is foamed outside the die. Then, the foamed release agent 11 is supplied to a cavity 9 defined in the die, and the die surface 10 is coated with the foamed release agent 11.

The die includes a fixed die 1, a movable die 2, and slidable cores 3 and 4. When the die is closed, the die defines the cavity 9 between the fixed die 1, the movable die 2, and the slidable cores 3 and 4. Upper pins 5 are slidably disposed within upper passages 7 so as to open and close the passages 7. Passages 7 are connected to the cavity 9. Similarly, lower pins 6 are slidably disposed within lower passages 8 so as to open and close the passages 8. Passages 8 are connected to the cavity 9 as well. By opening the upper passages 7 and the lower passages 8, the foamed release agent 11 can be introduced to the cavity 9 through, for example, the lower passages 8 and allow air to escape the cavity 9 through the upper passages, until the cavity 9 is filled with the foamed release agent 11. As a result, the die surface 10 is coated with the foamed release agent 11.

In the method according to the first embodiment of the present invention, because the release agent is foamed outside the die, any of the previously discussed foaming methods can be used without being affected by die conditions.

Figure 2:
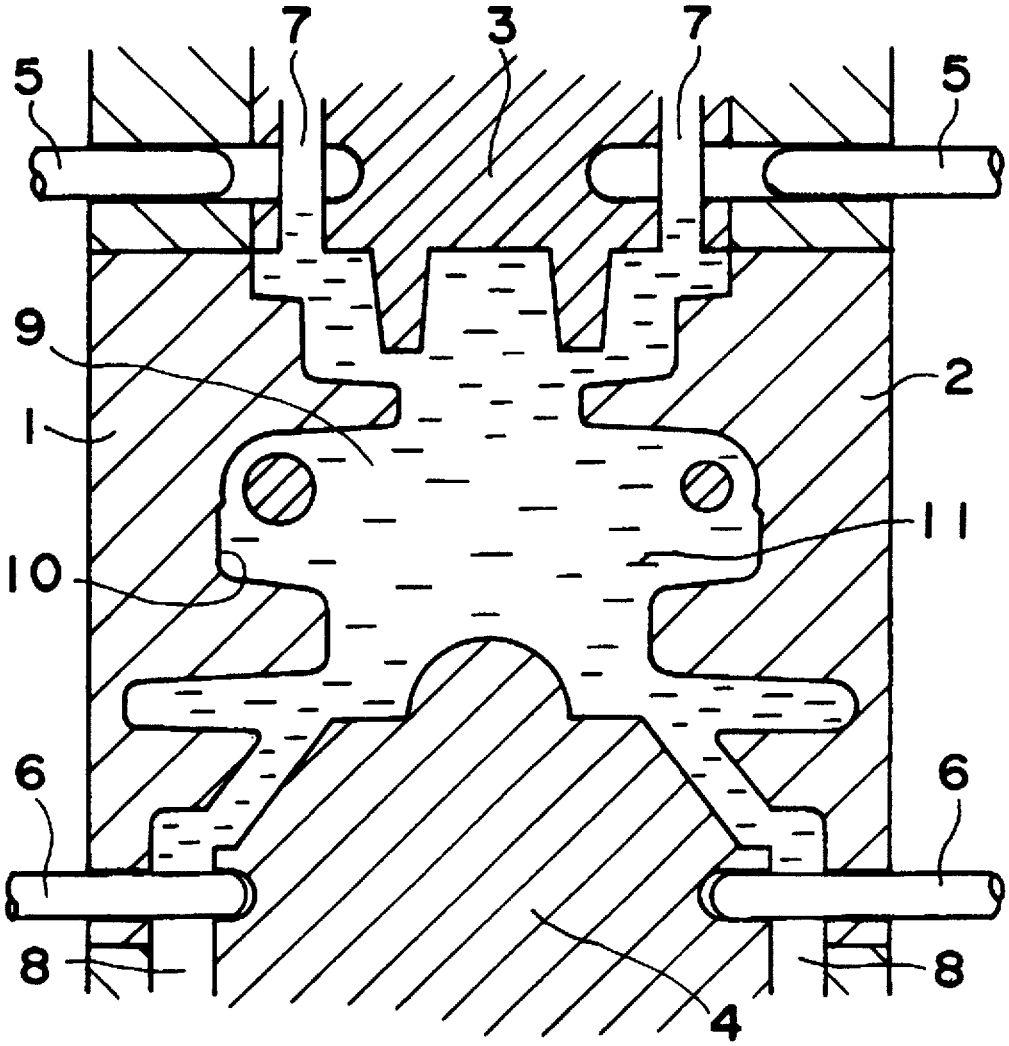
FIG. 2 is a cross-sectional view of a die supplied with a liquid release agent according to a second embodiment of the present invention.

In a second embodiment of the present invention, as illustrated in FIG. 2, liquid release agent is supplied to the cavity 9, and then the release agent is foamed. Thus, the release agent 11 is foamed inside the die.

Like the first embodiment, the die of the second embodiment includes a fixed die 1, a movable die 2, and slidable cores 3 and 4. After the die is closed, upper pins 5 and lower pins 6 are opened thereby opening upper passages 7 and lower passages 8 to the die cavity 9. Liquid (not yet foamed) release agent 11 is supplied to the cavity through the lower passages 8. Thereafter, the liquid release agent is released from the cavity 9 through the lower passages 8. Because the die surface 10 is coated with a liquid layer of release agent 11, a thickness of the release agent contacting the die surface is substantially uniform.

Next, the liquid release agent contacting the die surface 10 is foamed. Foaming methods 3, 4, or 5, as described above, are suitable for foaming the liquid release agent. Because the thickness of the liquid release agent contacting the die surface is substantially uniform, a thickness of a foamed release agent contacting the die surface also will also be uniform. After foaming, the process proceeds to steps depicted in FIG. 3 or FIG. 1.

Because the release agent 11 is foamed inside the die, the release agent does not need to be supplied quickly. Unlike the case where the release agent is foamed outside the die, there is no concern that the foam will dissipate in time. Consequently, a release agent supply device need not operate within a supply time parameter.

Figure 3:
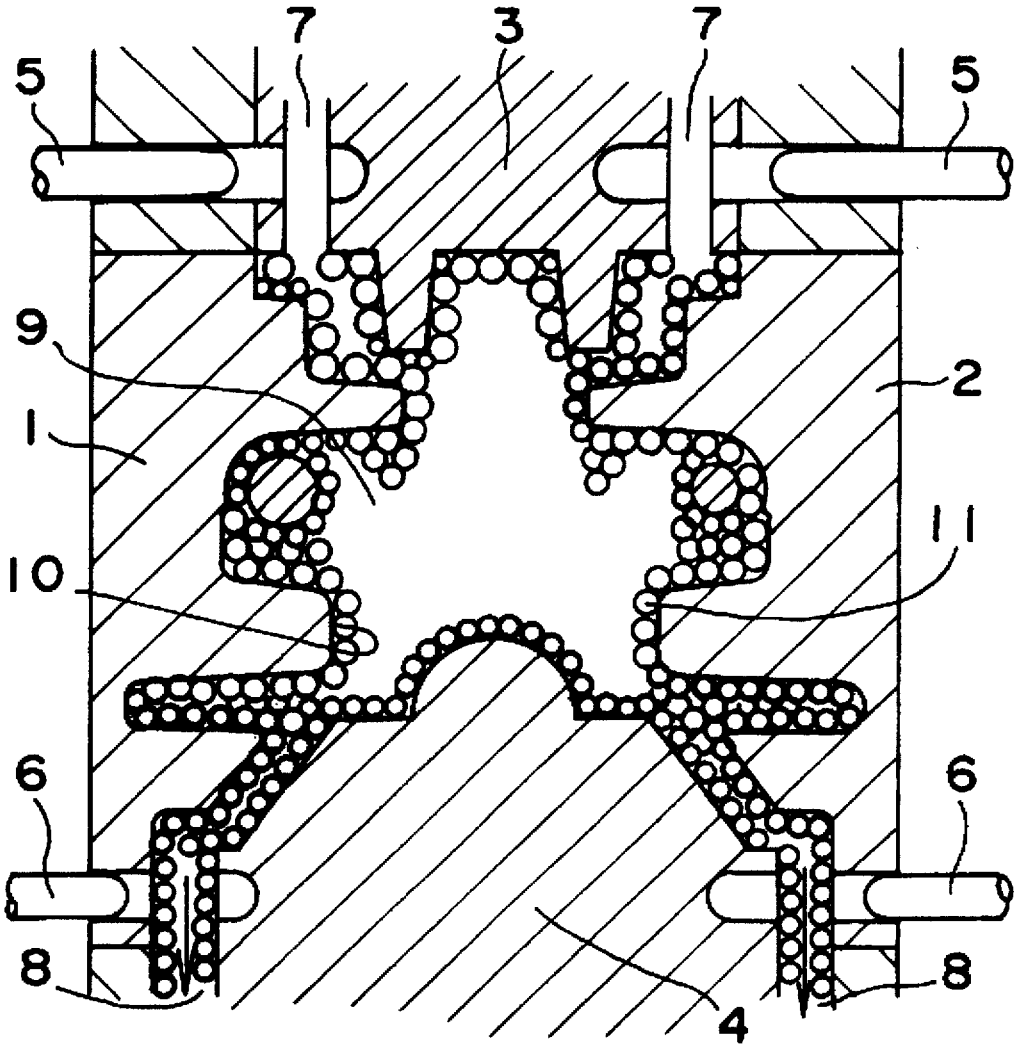
FIG. 3 is a cross-sectional view of a die with excess release agent removed according to a third embodiment of the present invention.
Figure 4:
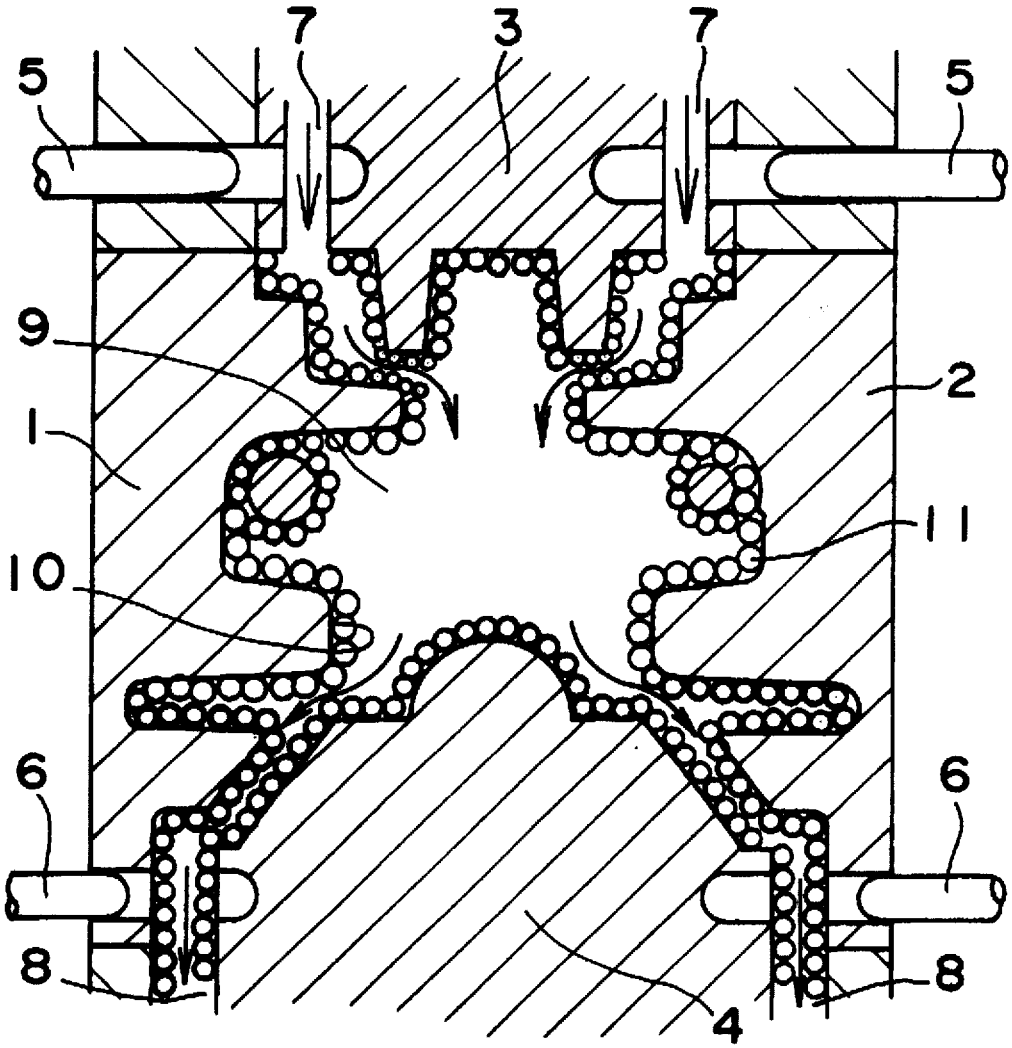
FIG. 4 is a cross-sectional view of a die with excess release agent compulsorily removed according to the third embodiment of the present invention.
Figure 5:
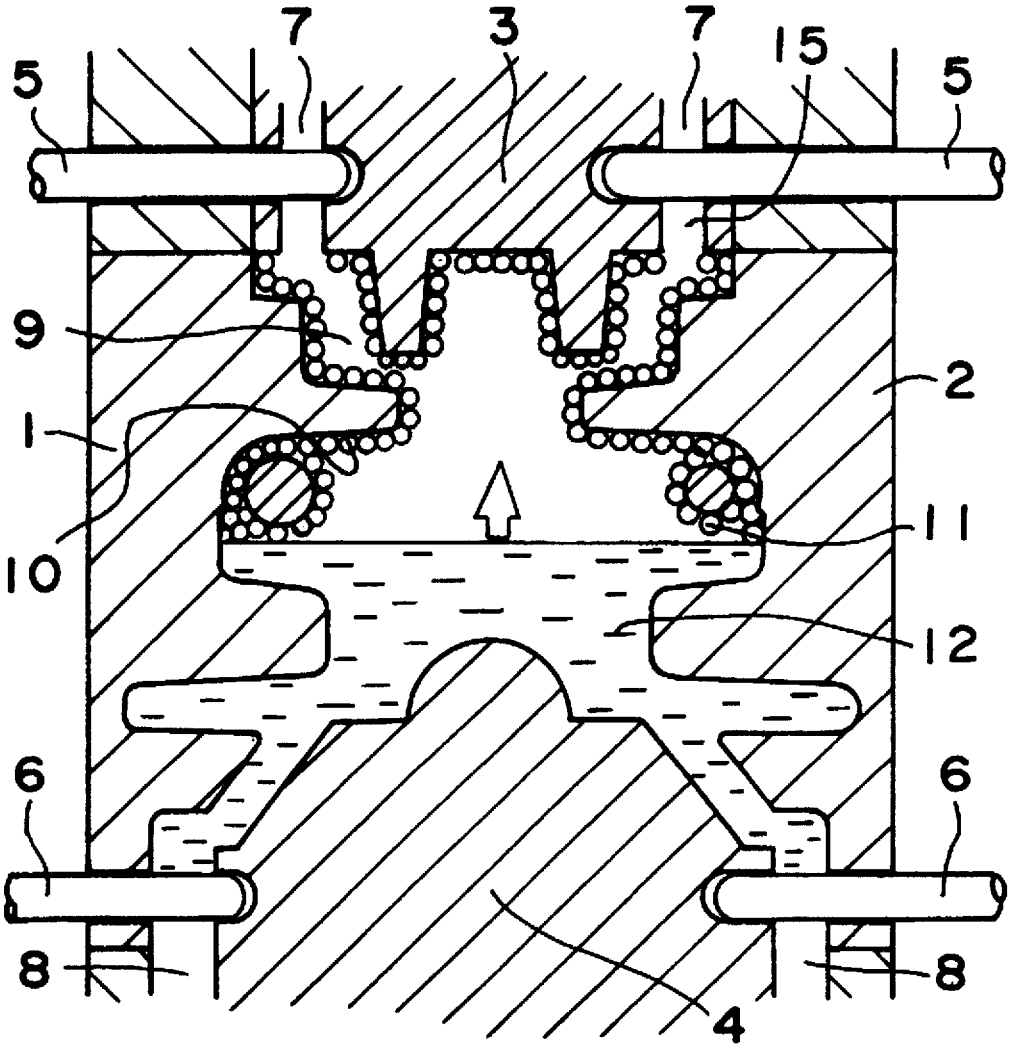
FIG. 5 is a cross-sectional view of a die supplied with molten metal following supply of a release agent according to any one of the first through third embodiments of the present invention.

A third embodiment of the present invention is illustrated in FIGS. 3–5. After the die surface 10 is coated with the foamed release agent 11, excess foamed release agent which does not contact the die surface 10 is removed from the cavity 9 before molten metal is supplied to the cavity 9.

As illustrated in FIG. 3, the excess release agent 11 is removed by gravity through the lower passages 8. Upper and lower passages 7 and 8 remain open during this removal.

Thereafter, as shown in FIG. 4, any remaining excess foamed release agent 11 is removed compulsorily from the die under the force of pressurized air. More particularly, upper and lower pins 5 and 6 are retracted to open upper and lower passages 7 and 8. The pressurized air is blown into the cavity 9 to force the remaining excess foamed release agent from the foamed release agent contacting the die surface 10 and out of the cavity 9. Following this process, the foamed release agent will be a single layer of substantially uniform thickness.

Alternatively, following the coating process as described in the first or second embodiment, excess release agent 11 may be removed by pressurized air alone. In other words, the excess foamed release agent may be removed by gravity alone, by forced air alone, or by the combination of gravity and forced air. In any case, the release agent 11 is removed easily because the release agent is foamed.

Finally, as illustrated in FIG. 5, the upper and lower pins 5 and 6 are closed to close the cavity 9, and molten metal 12, for example molten aluminum alloy, is supplied to the cavity 9 to fill it. The foamed release agent contacts the molten metal 12 and is absorbed by it. The molten metal solidifies to form a mold product. Then, the die is opened and the product is taken out of the die.

The process is repeated to produce the next mold product.

Figure 6:
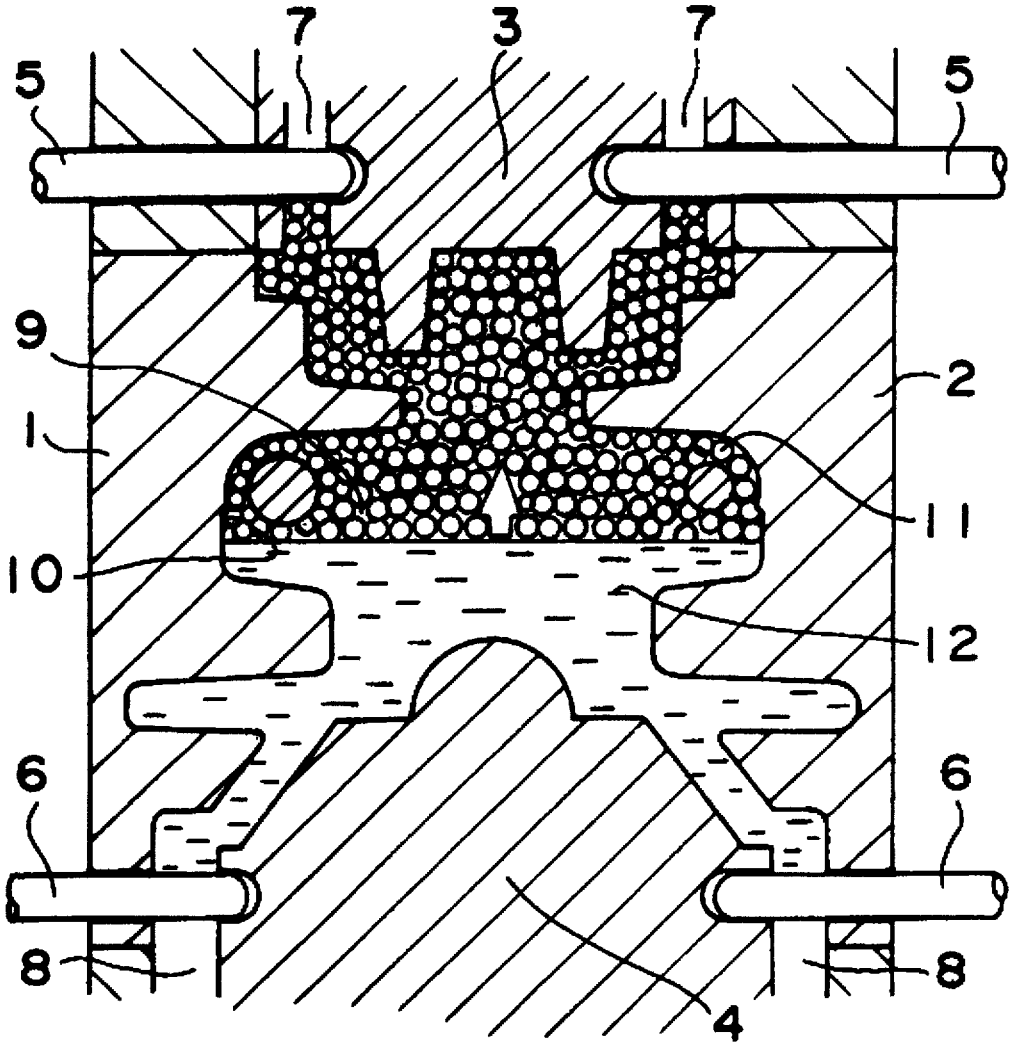
FIG. 6 is a cross-sectional view of a die supplied with molten metal according to a fourth embodiment of the present invention.

In a fourth embodiment of the present invention, as illustrated in FIG. 6, the foamed release agent is left in the cavity 9, and molten metal is supplied to the cavity 9. The cavity 9 is coated according to the steps of the first or second embodiment, and the molten metal is supplied to the die without removal of the excess release agent.

More particularly, either foamed release agent 11 is supplied to the cavity 9 or liquid release agent is supplied to the cavity 9 and thereafter foamed. As depicted in FIG. 6, upper and lower pins 5 and 6 are closed to close the cavity 9 leaving the foamed release agent 11 in the cavity 9. Molten metal 12, for example molten aluminum alloy, is supplied to the cavity 9 to fill it. As the molten metal contacts the foamed release agent, some of the release agent is absorbed by the molten metal. Though some of the release agent is absorbed by the molten metal, the amount absorbed is small. Most of the release agent is pushed to a foreign particle escaping portion 15 provided to the cavity thereby preventing mold defects.

In the fourth embodiment of the present invention, because the foamed release agent is left in the cavity 9, the total molding cycle time is reduced by the release agent removal time period. Moreover, molding without removal of the release agent by air blow can be adopted because the release agent is foamed.

Figure 7:
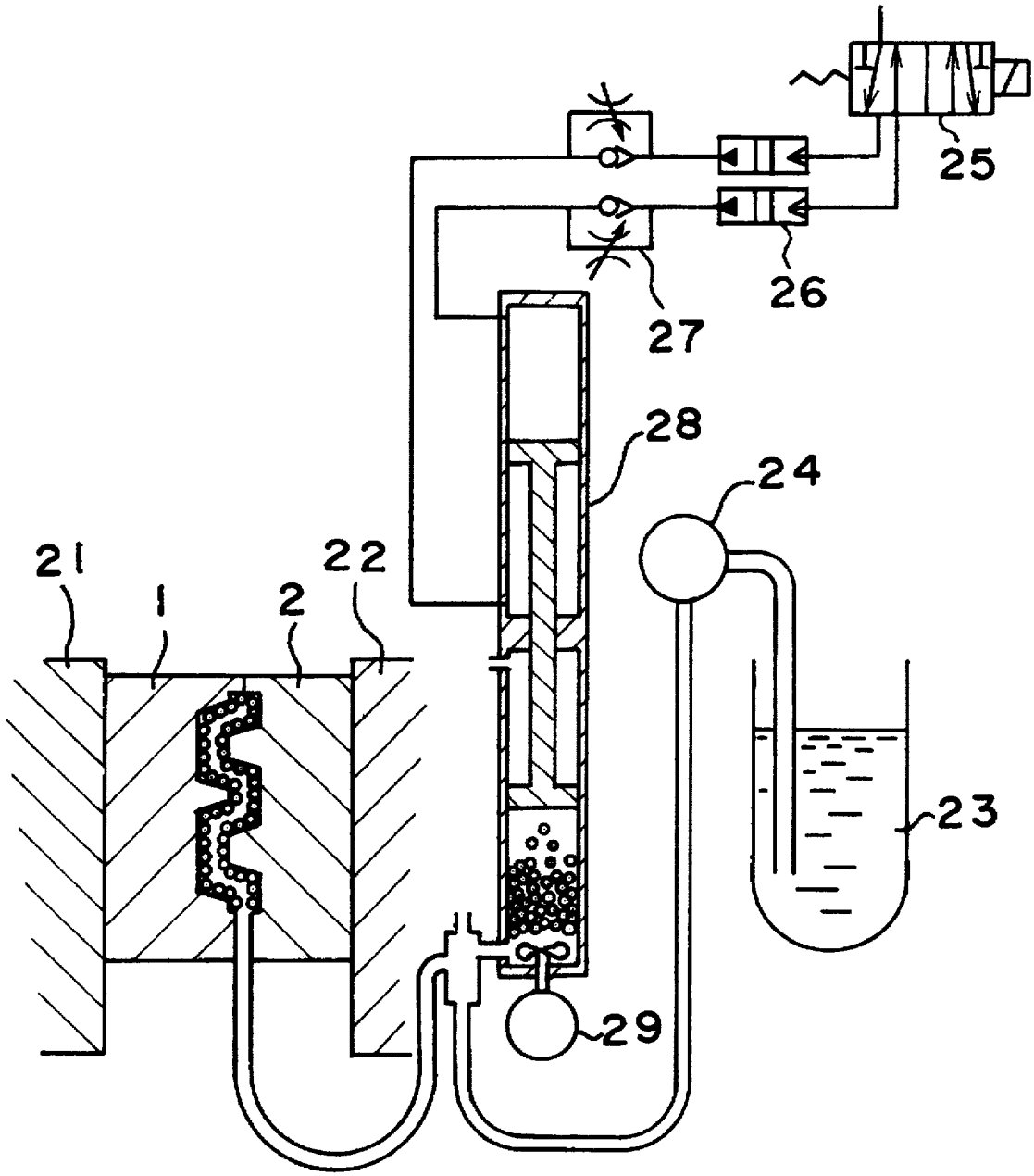
FIG. 7 is a cross-sectional view of a die and a release agent foaming apparatus for foaming and supplying a foamed release agent according to a fifth embodiment of the present invention.

In a fifth embodiment of the present invention, as illustrated in FIG. 7, the release agent 11 is foamed outside the die using a mechanical agitator 29. More particularly, a fixed die 1 is fixed to a fixed die plate 21 of a molding machine, and a movable die 2 is supported by a movable die plate 22 of the molding machine. Molten metal, for example molten aluminum alloy, is supplied to a cavity defined in the die and, thereafter, solidifies to a mold product. The die is opened and the mold product is removed. Then, the die is cooled to an appropriate temperature, and the die surface is coated with the foamed release agent 11 in preparation for the next cycle.

A predetermined amount of liquid release agent is fed to a cylinder 28 having predetermined volume from a release agent container 23 by a feed pump 24. The liquid release agent in the cylinder 28 is foamed by the agitator (or mixer) 29. The foamed release agent is fed quickly to the cavity before the foam dissipates. An air compressor 25, air-hydro unit 26, and electric control valve 27 assembly activates the cylinder 28 to feed the foam. After the cavity is filled with the foamed release agent and the excess release agent is removed from the cavity, molten metal, for example molten aluminum alloy, is supplied to the cavity. Because the release agent is foamed, the excess release agent is separated easily and removed from the release agent contacting the die surface.

Figure 8:
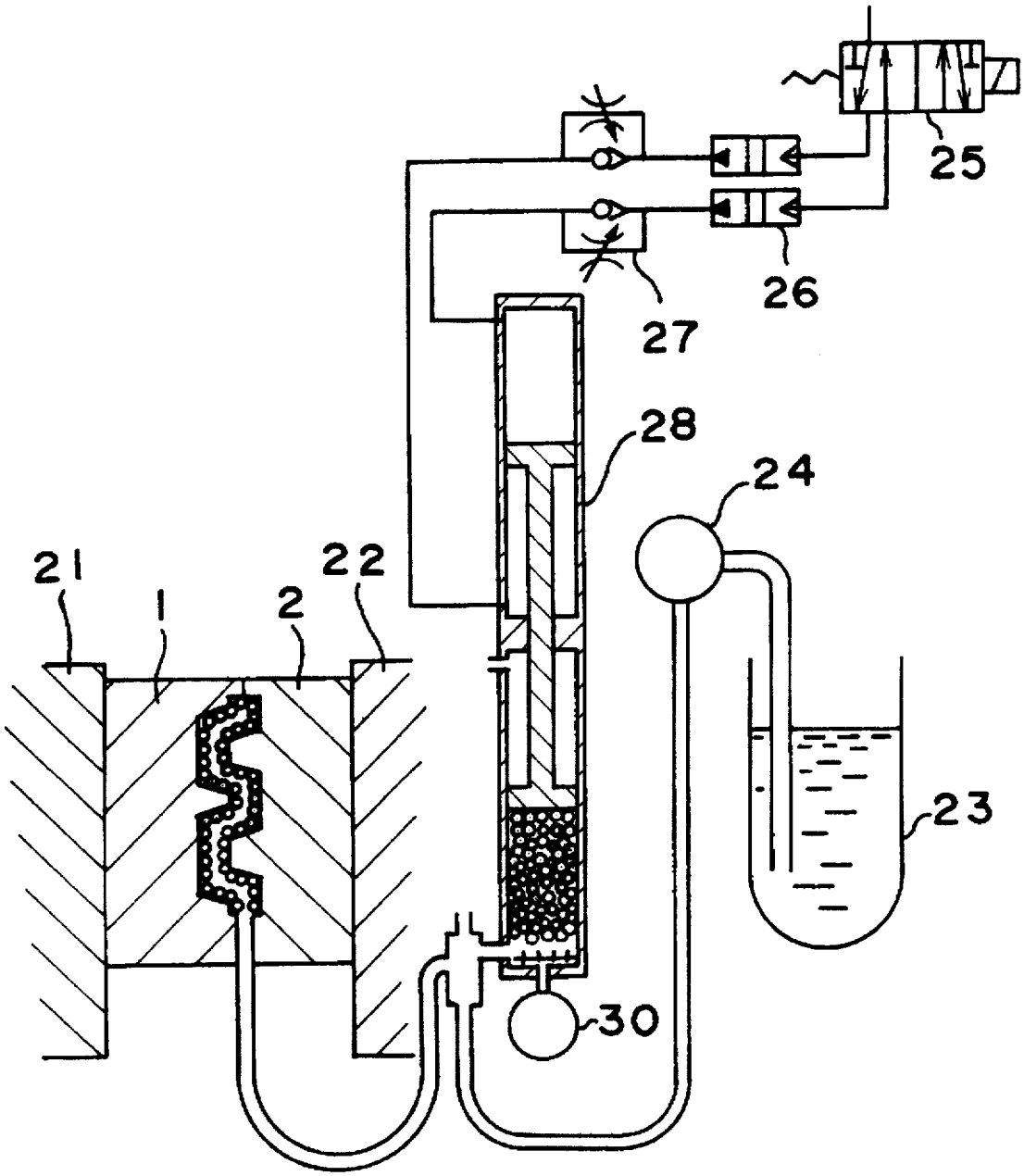
FIG. 8 is a cross-sectional view of a die and a release agent foaming apparatus for foaming and supplying a release agent according to a sixth embodiment of the present invention.

In a sixth embodiment of the present invention, as illustrated in FIG. 8, the release agent is foamed outside the die by injecting gas into the liquid release agent 11 from a nozzle 30. The same apparatus incorporated in the fifth embodiment of the present invention, except the agitator 29, can be used in the sixth embodiment of the present invention.

More particularly, a fixed die 1 is fixed to a fixed die plate 21 of a molding machine, and a movable die 2 is supported by a movable die plate 22 of the molding machine. Molten metal, for example molten aluminum alloy, is supplied to a cavity defined in the die and, thereafter, solidifies to a mold product. The die is opened and the mold product is removed. Then, the die is cooled to an appropriate temperature, and the cavity defining die surface is coated with the foamed release agent 11 in preparation for the next cycle.

A predetermined amount of liquid release agent is fed to a cylinder 28 having a predetermined volume from a release agent container 23 by a feed pump 24. The liquid release agent in the cylinder 28 is foamed by injecting air from nozzle 30 into the liquid release agent. The foamed release agent is fed quickly to the cavity before the foam dissipates. An air compressor 25, air-hydro unit 26, and electric control valve 27 assembly activates the cylinder 28 to feed the foam. After the cavity is filled with the foamed release agent and the excess release agent is removed from the cavity, molten metal, for example molten aluminum alloy, is supplied to the cavity. Because the release agent is foamed, the excess release agent is separated easily and removed from the release agent contacting the die surface.

Figure 9:
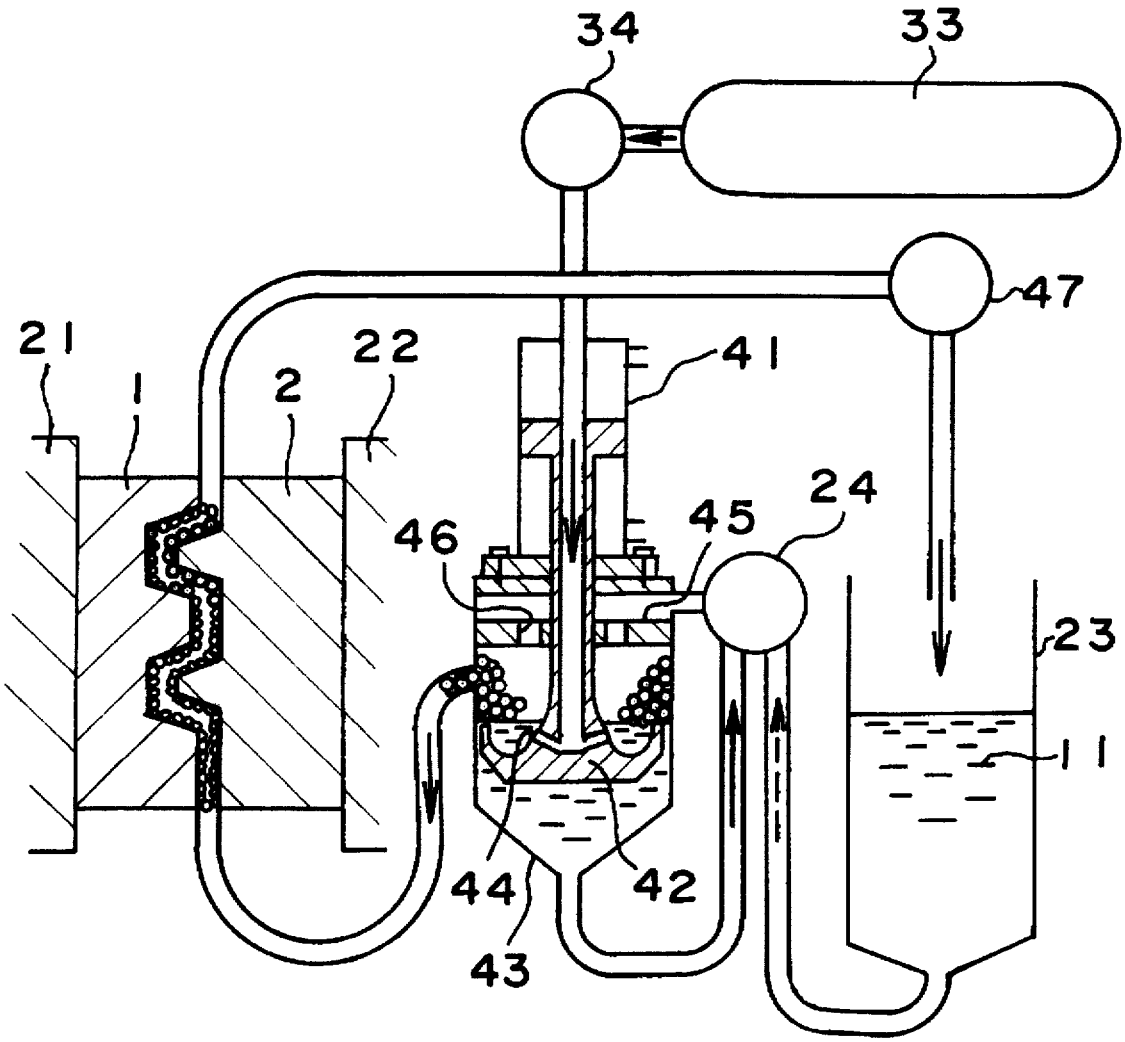
FIG. 9 is a cross-sectional view of a die and a release agent foaming apparatus for foaming and supplying a release agent according to a seventh embodiment of the present invention.

In a seventh embodiment of the present invention, as illustrated in FIG. 9, the release agent is foamed outside the die by injecting gas into the liquid release agent from a nozzle 44. Then, the foamed release agent is supplied to the die so that the die surface is coated with the foamed release agent. Carbonic acid gas is suitable for foaming the gas.

An amount of the carbonic acid gas contained in the bubbles of the foamed release agent is controlled by a nozzle adjustment, as described in more detail below. By adjusting a ratio of the amount of carbonic acid gas to an amount of air, the size of the bubbles of the foam can be controlled, because an amount of carbonic acid gas soluble in the membranes of the bubbles is controlled after formation of the foam. Specifically, the larger the ratio of carbonic acid gas to air, the smaller the size of bubbles formed. When the bubble size is small, the bubbles have a relatively long life and tend not to dissipate during conveyance to the cavity. On the other hand, if a significant quantity of foam dissipates, liquid release agent will collect on the die surface and cause mold defects. However, this problem is prevented effectively in this embodiment of the present invention. When the foamed release agent is supplied to the cavity, the foam is heated by the residual heat of the die, and the bubbles will grow in size so that it will be easier to remove excess foam from the cavity.

In FIG. 9, liquid release agent 11 at low temperature is fed from a release agent container 23 to a cylinder 43 by operating a circulation pump 24. The liquid release agent 11 is jetted, under pressure from the pump 24, from apertures 46 formed in a plate 45. The liquid release agent 11 thereafter flows along a surface of a parabolic shaft 42. At the same time, carbonic acid gas is supplied from a gas container 33 by operating a feed pump 34 through a passage formed in the shaft 42 and into a cylinder 43. Thereafter, the liquid release agent 11 is injected through nozzles 44 formed in the shaft 42 to the liquid release agent 11 by a predetermined amount thereby foaming the release agent.

The shaft 42 is connected to a hydraulic cylinder 41. The cylinder 41 adjusts the position of the shaft 42 relative to a surface of the liquid release agent thereby controlling an amount of air imparted to the foam. Any portion of the liquid release agent which has not been foamed by the injected carbonic acid gas drops through a gap between a periphery of the parabolic shaft 42 and the cylinder 43 to a bottom of the cylinder 43 and is, thereafter, circulated by the pump 24 back to the container 23. Therefore, the liquid release agent 11 is agitated at all times during the process. Finally, the foamed release agent 11 is suctioned into the die cavity by a suction pump 47. After cooling the die, any excess foamed release agent is removed from the cavity and returned to the container 23.

As discussed above, by adjusting the level of the nozzle 44 in the liquid release agent by operating the cylinder 41, a ratio of carbonic acid gas to air in the foam can be adjusted. Thus, a rate of cooling of the die by the foam can be controlled. In this instance, the larger the ratio of carbonic acid gas to air, the higher the rate of cooling of the die achieved.

Figure 10:
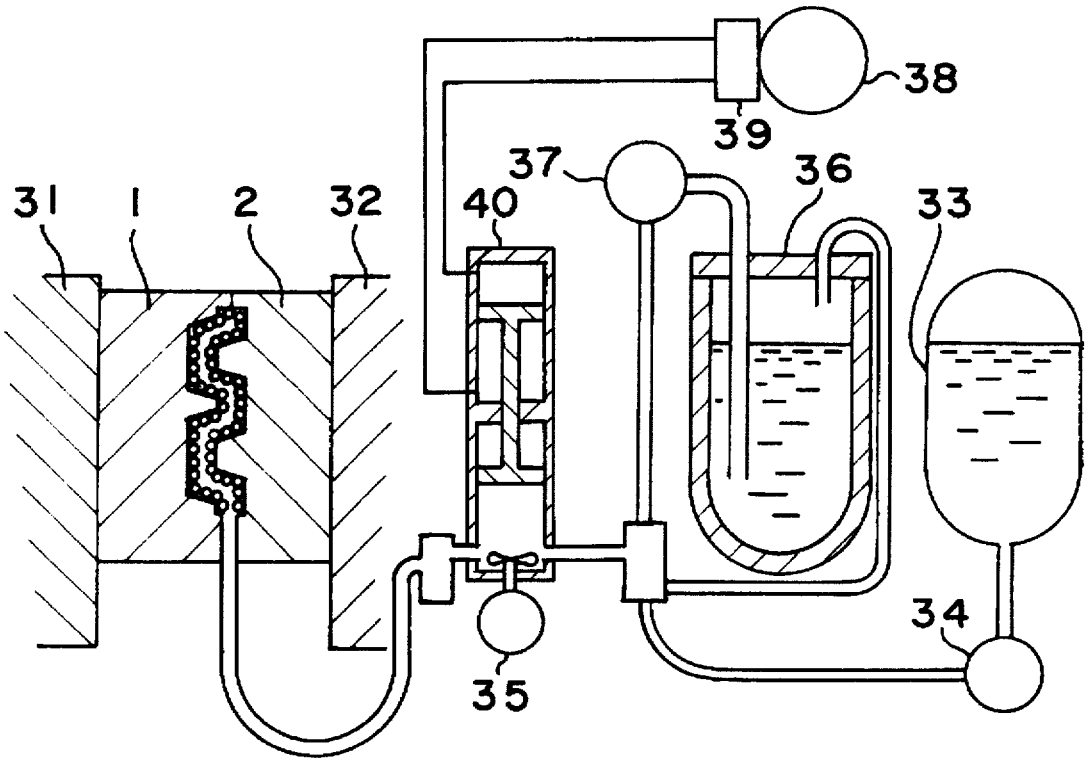
FIG. 10 is a cross-sectional view of a die and a release agent foaming apparatus for foaming and supplying a release agent according to an eighth embodiment of the present invention.

In an eighth embodiment of the present invention, as illustrated in FIG. 10, the release agent is foamed inside the die. More particularly, gas (for example, carbonic acid gas) is dissolved in the liquid release agent 11 or is first liquefied and then mixes with the liquid release agent 11 at high pressure and low temperature outside the die. Then, the liquid release agent 11 containing the gas is supplied to the die cavity. Finally, the liquid release agent 11 is foamed inside the die by the gas released from the release agent after being heated by the residual heat of the die. In this way, and the die surface is coated with the foamed release agent 11.

As shown in FIG. 10, a fixed die 1 is fixed to a fixed die plate 31 of a molding machine, and a movable die 2 is supported by a movable die plate 32 of the molding machine. Molten metal, for example molten aluminum alloy, is supplied to a cavity defined in the die and thereafter solidifies to a mold product. The die is opened and the mold product is removed. Thereafter, the die is cooled to an appropriate temperature and the die surface is coated with the foamed release agent 11.

A predetermined amount of liquid release agent cooled to about 0° C. is supplied to a cylinder 40 having a predetermined volume from a release agent container 36 by operating a feed pump 37. The cylinder 40 is operated by the assembly of an air compressor 38 and an electric control valve 39.

Carbonic acid gas is fed from a gas container 33 into the cylinder 40 by operating a feed pump 34. The carbonic acid gas is pressurized in the cylinder 40 and is either dissolved in the liquid release agent or is liquefied and mixed with the liquid release agent in the cylinder 40 by operating a mechanical agitator (or mixer) 35. Any method is acceptable so long as the liquid release agent contains sufficient carbonic acid gas to generate a strong foaming action when the release agent is heated.

A predetermined amount of the release agent is then fed into the cavity in the die by operating the cylinder 40 so that the die is cooled by the release agent and the release agent is heated by the residual heat of the die. Once heated, the release agent is foamed by the carbonic acid gas released from the release agent. Any portion of the release agent which has not been foamed is suctioned from the cavity by operating the cylinder 40. The die surface is coated with the foamed release agent. Finally, the molten metal supply step is initiated.

Although the present invention has been described with reference to specific exemplary embodiments, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

What is claimed is:

1. A method for coating a die surface of a closed, metal die with a release agent, comprising the steps of:

providing a closed, metal die having a die surface defining a die cavity;

providing a release agent;

foaming the release agent; and coating the die surface with the foamed release agent.

2. A method according to claim 1, wherein said release agent is foamed outside said die cavity.

3. A method according to claim 2, wherein the release agent is foamed by a mechanical agitator.

4. A method for coating a die surface of a die with a release agent, comprising the steps of:

foaming the release agent; and coating the die surface with the foamed release agent, wherein said release agent is foamed inside a die cavity of said die.

5. A method according to claim 4, wherein said step of foaming the release agent inside the die cavity comprises the steps of:

providing a treated release agent by dissolving a gas in the liquid release agent at high pressure and low temperature outside the die cavity;

supplying the treated release agent to the die cavity; and foaming the release agent by releasing the dissolved gas from the release agent when the treated release agent is heated by a residual heat of the die.

6. A method according to claim 4, wherein said step of foaming the release agent inside the die cavity comprises the steps of:

liquefying a gas;

mixing the gas with the release agent at high pressure and low temperature outside the die cavity;

supplying the release agent to the die cavity; and foaming the release agent by a gas released from the release agent when the release agent is heated by a residual heat of the die.

7. A method according to claim 4, wherein said step of foaming the release agent includes the steps of:

mixing the release agent with a surface active agent; and supplying the release agent and the surface active agent to the die cavity to cause the release agent to contact the die surface.

8. A method for coating a die surface of a die with a release agent, comprising the steps of:

foaming the release agent;

coating the die surface with the foamed release agent;

removing excess release agent from a cavity defined in the die; and supplying molten metal to the cavity.

9. A method for coating a die surface of a die with a release agent, comprising the steps of:

foaming the release agent;

coating the die surface with the foamed release agent;

leaving excess release agent in a cavity defined in the die; and supplying molten metal to the die cavity.

10. A method according to claim 9, wherein the excess release agent is absorbed by the molten metal.

11. A method according to claim 9, wherein the excess release agent is pushed to a foreign particle escaping portion.

12. A method for coating a die surface of a die with a release agent, comprising the steps of:

foaming the release agent; and coating the die surface with the foamed release agent, wherein said release agent is foamed outside a die cavity defined in the die, wherein the release agent is foamed by injecting gas into the release agent.

13. A method according to claim 12, wherein said gas is carbonic acid gas.

14. A method according to claim 12, wherein the gas is injected into the release agent by a nozzle.

15. A method according to claim 14, wherein the nozzle is disposed relative to a surface level of the release agent so that air is mixed with the gas.

16. A method according to claim 15, wherein a nozzle position of the nozzle relative to the surface level of the release agent is varied to change a ratio of air mixed with the gas.

17. A method for coating a die surface of a die with a release agent comprising the steps of:

foaming the release agent; and coating the die surface with the foamed release agent, wherein said release agent is foamed outside a die cavity defined in the die, wherein said step of foaming the release agent includes the steps of:

mixing the release agent with a foam generating material comprising one of sodium laureate and sodium stearate; and foaming the release agent and the foam generating material by one of mechanically agitating the release agent and blowing air into the release agent.

18. A method for coating a die surface of a die with a release agent comprising the steps of:

foaming the release agent; and coating the die surface with the foamed release agent, wherein said release agent is foamed outside a die cavity defined in the die, wherein said step of foaming the release agent includes the steps of:

providing a foam generating material by mixing sodium hydrocarbonate powders with air; and adding the foam generating material to the release agent.

19. A method for coating a die surface of a die with a release agent comprising the steps of:

foaming the release agent; and coating the die surface with the foamed release agent, wherein said release agent is foamed outside a die cavity defined in the die, wherein said step of foaming the release agent includes the steps of:

adding volatile alcohol to the release agent at high pressure to foam the release agent.

* * * * *